US012258707B2

(12) United States Patent
Pataut et al.

(10) Patent No.: US 12,258,707 B2
(45) Date of Patent: Mar. 25, 2025

(54) SINGLE-LAYER MULTI-STRAND CABLE HAVING IMPROVED ENERGY AT BREAK AND AN IMPROVED TOTAL ELONGATION

(71) Applicant: COMPAGNIE GENERALE DES ETABLISSEMENTS MICHELIN, Clermont-Ferrand (FR)

(72) Inventors: Gael Pataut, Clermont-Ferrand (FR); Henri Barguet, Clermont-Ferrand (FR); Lucas Lauby, Clermont-Ferrand (FR); Olivier Reix, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 249 days.

(21) Appl. No.: 17/791,272

(22) PCT Filed: Dec. 18, 2020

(86) PCT No.: PCT/FR2020/052526

§ 371 (c)(1),
(2) Date: Jul. 7, 2022

(87) PCT Pub. No.: WO2021/140287

PCT Pub. Date: Jul. 15, 2021

(65) Prior Publication Data

US 2023/0349097 A1 Nov. 2, 2023

(30) Foreign Application Priority Data

Jan. 7, 2020 (FR) ..... 2000097

(51) Int. Cl.
*D07B 1/06* (2006.01)
*D07B 7/02* (2006.01)

(52) U.S. Cl.
CPC ..... *D07B 1/0613* (2013.01); *D07B 1/0646* (2013.01); *D07B 7/025* (2013.01);
(Continued)

(58) Field of Classification Search
CPC .... D07B 1/0613; D07B 1/0646; D07B 7/025; B60C 9/0007
See application file for complete search history.

(56) References Cited

U.S. PATENT DOCUMENTS 4,265,291 A 5/1981 Pommier
4,274,464 A 6/1981 Pommier
(Continued)

FOREIGN PATENT DOCUMENTS

EP 0143767 A1 6/1985
EP 0376272 A1 7/1990
(Continued)

OTHER PUBLICATIONS

International Search Report dated Mar. 25, 2021, in corresponding PCT/FR2020/052526 (4 pages).

*Primary Examiner* — Shaun R Hurley
(74) *Attorney, Agent, or Firm* — VENABLE LLP

(57) ABSTRACT

A multi-strand cord (50) having a 1×N structure comprises a single layer (52) of N strands (54) wound in a helix about a main axis (A), each strand (54) having one layer (56) of metal filaments (F1) and comprising M>1 metal filaments wound in a helix about an axis (B). The cord (50) has a total elongation At>8.10% and the energy-at-break indicator Er of the cord (50), defined by $Er=\int_0^{At}\sigma(Ai)\times dAi$ where σ(Ai) is the tensile stress in MPa measured at the elongation Ai and dAi is the elongation such that Er is strictly greater than 52 $MJ/m^3$.

18 Claims, 9 Drawing Sheets

(52) U.S. Cl.
CPC ..... *D07B 2201/1048* (2013.01); *D07B 2201/1064* (2013.01); *D07B 2201/2022* (2013.01); *D07B 2401/201* (2013.01)

(56) References Cited

U.S. PATENT DOCUMENTS

| | | | | |
|---|---|---|---|---|
| 5,048,280 | A | 9/1991 | Okamoto et al. | |
| 5,533,327 | A | 7/1996 | Eckehard | |
| 10,364,529 | B2 | 7/2019 | Calvet et al. | |
| 10,378,128 | B2 | 8/2019 | Calvet et al. | |
| 10,704,195 | B2 | 7/2020 | Pironneau et al. | |
| 11,760,128 | B2 | 9/2023 | Cornille et al. | |
| 12,036,830 | B2 | 7/2024 | Barguet et al. | |
| 2016/0152082 | A1* | 6/2016 | Wang | D02G 3/48 57/237 |
| 2017/0321352 | A1 | 11/2017 | Calvet et al. | |
| 2017/0321376 | A1 | 11/2017 | Calvet et al. | |
| 2018/0010294 | A1 | 1/2018 | Pironneau et al. | |
| 2018/0044455 | A1* | 2/2018 | Castellani | C08K 3/04 |

FOREIGN PATENT DOCUMENTS

| | | | |
|---|---|---|---|
| EP | 0548539 | A2 | 5/1993 |
| EP | 0622489 | A1 | 11/1994 |
| EP | 1000194 | B1 | 9/2002 |
| FR | 2419181 | A1 | 10/1979 |
| FR | 2419182 | A1 | 10/1979 |
| JP | 6-346386 | A | 12/1994 |
| JP | 2007-92259 | A | 4/2007 |
| JP | 2014-55369 | A | 3/2014 |
| WO | 2007/128335 | A1 | 11/2007 |
| WO | 2012/055677 | A2 | 5/2012 |
| WO | 2016/083265 | A1 | 6/2016 |
| WO | 2016/083267 | A1 | 6/2016 |
| WO | 2016/131862 | A1 | 8/2016 |

* cited by examiner

SINGLE-LAYER MULTI-STRAND CABLE HAVING IMPROVED ENERGY AT BREAK AND AN IMPROVED TOTAL ELONGATION

The invention relates to cords, to a reinforced product, and to a tyre comprising these cords.

A tyre for a construction plant vehicle, having a radial carcass reinforcement comprising a tread, two inextensible beads, two sidewalls connecting the beads to the tread and a crown reinforcement, disposed circumferentially between the carcass reinforcement and the tread, is known from the prior art, notably from document WO2016/131862. This crown reinforcement comprises several plies reinforced by reinforcing elements such as metal cords, the cords of one ply being embedded in an elastomer matrix of the ply.

The crown reinforcement comprises a working reinforcement, a protective reinforcement and possibly other reinforcements, for example a hoop reinforcement.

The protective reinforcement comprises one or more protective plies comprising several protective filamentary reinforcing elements. Each protective filamentary reinforcing element is a cord having a 1×N structure. The cord comprises a single layer of N=4 strands wound in a helix with a pitch of p3=20 mm. Each strand comprises not only an internal layer of M=3 internal filaments wound in a helix with a pitch of p1=6.7 mm but also an external layer of V=8 external filaments wound in a helix around the internal layer with a pitch of p2=10 mm. Each internal filament and external filament has a diameter equal to 0.35 mm and the total elongation of the cord is 6%.

On the one hand, as the tyre passes over obstacles, for example in the form of rocks, these obstacles risk perforating the tyre as far as the crown reinforcement. These perforations allow corrosive agents to enter the crown reinforcement of the tyre and reduce the life thereof.

On the other hand, it has been found that the cords of the protective plies may exhibit breakages resulting from relatively significant deformations and loads applied to the cord, in particular as the tyre passes over obstacles.

The aim of the invention is a cord which makes it possible to reduce, or even eliminate, the number of breakages and the number of perforations.

To this end, one subject of the invention is a multi-strand cord having a 1×N structure comprising a single layer of N strands wound in a helix about a main axis (A), each strand having one layer of metal filaments and comprising M>1 metal filaments wound in a helix about an axis (B), wherein:

- the cord has a total elongation At>8.10% determined by the standard ASTM D2969-04 from 2014; and
- the energy-at-break indicator Er of the cord, defined by $Er=\int_0^{At}\sigma(Ai)\times dAi$ where σ(Ai) is the tensile stress in MPa measured at the elongation Ai and dAi is the elongation such that Er is strictly greater than 52 $MJ/m^3$.

By virtue of the relatively high total elongation and of the relatively high energy at break of the cord, the cord according to the invention makes it possible to reduce perforations and therefore lengthen the life of the tyre. Specifically, the inventors behind the invention have discovered that a cord less stiff than that of the prior art performs better with respect to obstacles. The inventors have found that it was more effective to hug the obstacle by using a cord with a lower stiffness than to attempt to stiffen and reinforce the cords as far as possible in order to oppose the deformations imposed by obstacles as is taught in a general manner in the prior art. By hugging the obstacles, the load set against the obstacles is reduced, and therefore so is the risk of the tyre being perforated. This stiffness reduction effect is illustrated in FIG. 7 where, under stress the cord according to the invention exhibits good deformability under light load thanks to the radial clearance of the filaments.

By virtue of the relatively high total elongation and of the relatively high energy at break of the cord, the cord according to the invention also makes it possible to reduce the number of breakages. Specifically, the inventors behind the invention have discovered that the determining criterion for reducing cord breakages was not only the force at break, as is widely taught in the prior art, but the energy-at-break indicator, which, in the present application is represented by the area under the curve of stress as a function of elongation, as illustrated in part in FIG. 4. Specifically, the cords of the prior art either have a relatively high force at break but a relatively low elongation at break, or a relatively high elongation at break but a relatively low force at break. In both cases, the cords of the prior art break with a relatively low energy-at-break indicator. The cord according to the invention, because of its relatively high total elongation, exhibits an elongation at break which is necessarily relatively high. Synergistically, the relatively low modulus makes it possible to push back the elongation at break on account of a relatively low gradient of the stress-elongation curve in the elastic domain. Finally, and above all, the inventors have discovered that the increase in the total elongation made it possible, as is shown by the comparative tests hereinbelow, not only to push back the elongation at break but also therefore to increase the stress, thereby making it possible to increase the energy at break.

Any range of values denoted by the expression "between a and b" represents the range of values extending from more than a to less than b (namely excluding the end-points a and b), whereas any range of values denoted by the expression "from a to b" means the range of values extending from the end-point "a" as far as the end-point "b", namely including the strict end-points "a" and "b".

The total elongation At, which is a parameter well known to a person skilled in the art, is determined for example by applying the standard ASTM D2969-04 of 2014 to a cord tested so as to obtain a stress-elongation curve. The At is deduced from the curve obtained as being the elongation, in %, corresponding to the projection onto the elongation axis of the point on the stress-elongation curve at which the cord breaks, namely the point at which the load increases to a maximum stress value and then decreases sharply after breakage. When the decrease with regard to stress exceeds a certain level, that means that breakage of the cord has occurred.

The energy-at-break indicator Er of the cord is determined by calculating the area under the curve of tensile stress as a function of elongation using the relationship $Er=\int_0^{At}\sigma(Ai)\times dAi$. This energy-at-break indicator represents a specific energy density in $MJ/m^3$. The rectangle method is conventionally used to determine this area: the tensile stress sigma (Ai) being expressed in MPa measured at the elongation Ai expressed as a dimensionless %; for i=0: Ai=0=A0=0% elongation, and for i=t: Ai=t=At: total elongation at break for the cord. The energy-at-break indicator Er is thus the sum of $(\frac{1}{2}(\sigma(Ai)+\sigma(Ai+1))\times(Ai+1-Ai)$ for i ranging from 0 to t. For this integration, the sampling of the rectangles is defined in such a way that the widths defined by (Ai+1−Ai) are substantially equal to 0.025%, namely 4 rectangles for 0.1% elongation as depicted in FIG. 4.

In the invention, the cord comprises a single layer of N strands, which is to say that it comprises an assembly made up of one layer of strands, neither more nor less, which is to say that the assembly has one layer of strands, not zero, not two, but only one.

Advantageously, the direction of winding of each strand is the opposite to the direction of winding of the cord.

What is meant by the direction of winding of a layer of strands is the direction that the strands form with respect to the axis of the cord. The direction of winding is commonly designated by either the letter Z or the letter S.

The directions of winding of the strands are determined in accordance with the standard ASTM D2969-04 of 2014.

The cord according to the invention has a single helix. By definition, a single-helix cord is a cord in which the axis of each strand of the layer describes a single helix about a main axis, in contrast to a double-helix cord, in which the axis of each strand describes a first helix about the axis of the cord and a second helix about a helix described by the axis of the cord. In other words, when the cord extends in a substantially rectilinear direction, the cord comprises a single layer of strands wound together in a helix, each strand of the layer describing a helical path about a main axis substantially parallel to the substantially rectilinear direction, such that, in a plane of section substantially perpendicular to the main axis, the distance between the centre of each strand of the layer and the main axis is substantially constant and identical for all the strands of the layer. By contrast, when a double-helix strand extends in a substantially rectilinear direction, the distance between the centre of each strand of the layer and the substantially rectilinear direction is different for all of the strands of the layer.

In the same way as described above for the cord, each strand according to the invention has a single helix. By definition, a single-helix strand is a strand in which the axis of each metal filamentary element of the layer describes a single helix, in contrast to a double-helix strand, in which the axis of each metal filamentary element describes a first helix about the axis of the strand and a second helix about a helix described by the axis of the strand. In other words, when the strand extends in a substantially rectilinear direction, the strand comprises a single layer of metal filamentary elements wound together in a helix, each metal filamentary element of the layer describing a helical path about a main axis substantially parallel to the substantially rectilinear direction, such that, in a plane of section substantially perpendicular to the main axis, the distance between the centre of each metal filamentary element of the layer and the main axis is substantially constant and identical for all the metal filamentary elements of the layer. By contrast, when a double-helix strand extends in a substantially rectilinear direction, the distance between the centre of each metal filamentary element of the layer and the substantially rectilinear direction is different for all of the metal filamentary elements of the layer.

The cord according to the invention has no metal central core. It is also referred to as a cord of 1×N structure in which N is the number of strands or else as an "open cord" (cord with an open structure). In the above-defined cord according to the invention, the internal enclosure is empty and therefore devoid of any filling material, notably devoid of any elastomeric composition. It is then referred to as a cord devoid of filling material.

A filamentary element means an element extending longitudinally along a main axis and having a section perpendicular to the main axis, the largest dimension G of which is relatively small compared with the dimension L along the main axis. The expression relatively small means that L/G is greater than or equal to 100, preferably greater than or equal to 1000. This definition covers both filamentary elements with a circular section and filamentary elements with a non-circular section, for example a polygonal or oblong section. Very preferably, each metal filamentary element has a circular section.

By definition, the term metal means a filamentary element made up mostly (i.e. more than 50% of its weight) or entirely (100% of its weight) of a metallic material. Each metal filamentary element is preferably made of steel, more preferably pearlitic or ferritic-pearlitic carbon steel, commonly referred to as carbon steel by a person skilled in the art, or made of stainless steel (by definition steel comprising at least 10.5% chromium).

Preferably, the metal filaments and the strands do not undergo pre-shaping. In other words, the cord is obtained by a method that does not have steps of individually preforming each of the metal filamentary elements and each of the strands.

Advantageously, the total elongation At≥8.30% and preferably At≥8.50%.

Advantageously, the total elongation At≤20.00% and preferably At≤16.00%.

Advantageously, the energy-at-break indicator Er of the cord (50) is greater than or equal to 55 $MJ/m^3$.

Preferably, the energy-at-break indicator Er of the cord (50) is less than or equal to 200 $MJ/m^3$ and preferably less than or equal to 150 $MJ/m^3$.

As a preference, the cord has a structural elongation As determined by the standard ASTM D2969-04 of 2014 such that As>4.30%, preferably As≥4.50% and more preferentially As≥4.60%.

As a preference, the cord has a structural elongation As determined by the standard ASTM D2969-04 of 2014 such that As≤10.0% and preferably As≤9.50%.

The structural elongation As, which is a parameter well known to those skilled in the art, is determined for example by applying the standard ASTM D2969-04 of 2014 to a cord tested in such a way as to obtain a force-elongation curve. The As is deduced from the curve obtained as being the elongation, as a %, that corresponds to the projection, onto the elongation axis, of the intersection between the tangent to the structural part of the force-elongation curve and the tangent to the elastic part of the force-elongation curve. Remember that a force-elongation curve comprises, progressing towards increasing elongations, a structural part, an elastic part and a plastic part. The structural part corresponds to the structural elongation As resulting from the aeration of the cord, which is to say the vacant space between the various metal strands that make up the cord. The elastic part corresponds to an elastic elongation resulting from the construction of the cord, notably from the angles of the various layers and the diameters of the strands. The plastic part corresponds to the plastic elongation resulting from the plasticity (irreversible deformation beyond the elastic limit) of one or more metal filamentary elements of the strands.

As a preference, the cord has a secant modulus E1 ranging from 3.0 to 10.0 GPa, and preferably ranging from 3.5 to 8.5 GPa.

The cord according to the invention may thus have a significant deformation for a small force and a low first stiffness.

The secant modulus E1 is the gradient of the straight line connecting the origin of the stress-elongation curve obtained under the conditions of the standard ASTM D 885/D 885M-10a of 2014 to the 1% abscissa point on this same curve.

Preferably, the cord has a tangent modulus E2 ranging from 50 to 180 GPa, and preferably from 55 to 150 GPa.

Thus, the cord according to the invention has minimum stiffness to allow it to absorb or transmit load.

The tangent modulus E2 is calculated as follows on the force-elongation curve obtained under the conditions of the standard ASTM D 885/D 885M-10a of 2014: E2 corresponds to the maximum tangent modulus of the cord on the force-elongation curve.

Another subject of the invention is a cord extracted from a polymer matrix, the extracted cord having a 1×N structure comprising a single layer of N strands wound in a helix about a main axis (A), each strand having one layer of metal filaments and comprising M>1 metal filaments wound in a helix about a main axis (B), wherein:

the extracted cord (50') has a total elongation At'≥5.00% determined by the standard ASTM D2969-04 of 2014, the energy-at-break indicator Er' of the extracted cord (50'), defined by $Er'=\int_0^{At'}\sigma(Ai)\times dAi$ where σ(Ai) is the tensile stress in MPa measured at the elongation Ai and dAi is the elongation such that Er' is strictly greater than 35 MJ/m$^3$.

Preferably, the polymer matrix is an elastomer matrix.

The polymer matrix, preferably elastomer matrix, is based on a polymer, preferably elastomer, composition.

A polymer matrix is understood to be a matrix comprising at least one polymer. The polymer matrix is thus based on a polymer composition.

What is meant by an elastomer matrix is a matrix containing at least one elastomer. The preferred elastomer matrix is thus based on the elastomer composition.

The expression "based on" should be understood as meaning that the composition comprises the compound and/or the product of the in situ reaction of the various constituents used, some of these constituents being able to react and/or being intended to react with one another, at least partially, during the various phases of manufacture of the composition; the composition thus being able to be in the fully or partially crosslinked state or in the non-crosslinked state.

A polymer composition is understood as meaning that the composition comprises at least one polymer. Preferably, such a polymer may be a thermoplastic, for example a polyester or a polyamide, a thermosetting polymer, an elastomer, for example natural rubber, a thermoplastic elastomer or a combination of these polymers.

An elastomer composition is understood as meaning that the composition comprises at least one elastomer and at least one other component. Preferably, the composition comprising at least one elastomer and at least one other component comprises an elastomer, a crosslinking system and a filler. The compositions that can be used for these plies are conventional compositions for the skim coating of filamentary reinforcing elements and comprise a diene elastomer, for example natural rubber, a reinforcing filler, for example carbon black and/or silica, a crosslinking system, for example a vulcanizing system, preferably comprising sulphur, stearic acid and zinc oxide, and optionally a vulcanization accelerant and/or retarder and/or various additives. The adhesion between the metal filaments and the matrix in which they are embedded is afforded for example by a metal coating, for example a layer of brass.

The values of the features described in the present application for the extracted cord are measured on or determined from cords extracted from a polymer matrix, in particular an elastomer matrix, for example of a tyre. Thus, for example on a tyre, the strip of material radially on the outside of the cord that is to be extracted is removed in order to be able to see the cord that is to be extracted radially flush with the polymer matrix. This removal can be done by stripping using cutters and knives, or by planing. Next, the end of the cord that is to be extracted is disengaged using a knife. The cord is then pulled so as to extract it from the matrix, applying a relatively shallow angle in order not to plasticize the cord that is to be extracted. The extracted cords are then carefully cleaned, for example using a knife, so as to detach any remains of polymer matrix locally adhering to the cord, while taking care not to damage the surface of the metal filaments.

As a preference, the total elongation At' is such that At'≥5.20%.

As a preference, the energy-at-break indicator Er' of the cord (50) is greater than or equal to 40 MJ/m$^3$.

The advantageous features described hereinbelow apply equally to the cord as defined above and to the extracted cord.

Advantageously, the cord is such that the strands define an internal enclosure of the cord of diameter Dv, each strand having a diameter Dt and having a helix radius of curvature Rt, defined by Rt=Pe/(π×Sin(2αe)) where Pe is the pitch of each strand expressed in millimetres and αe is the helix angle of each strand (54), where Dv, Dt and Rt being expressed in millimetres: 25≤Rt/Dt≤180 and 0.10≤Dv/Dt≤0.50.

The cord according to the invention exhibits excellent longitudinal compressibility and, all other things being equal, a relatively small diameter.

The inventors behind the invention postulate that, first, on account of a sufficiently large radius of curvature Rt with respect to the diameter Dt of each strand, the cord is sufficiently aerated, thereby reducing the risk of buckling, on account of the relatively large spacing of each strand from the longitudinal axis of the cord, this spacing allowing the strands, on account of their helix, to accommodate relatively high longitudinal compressive deformations. In contrast, because the radius of curvature Rt of each strand of the cord of the prior art is relatively small in comparison with the diameter Dt, the metal filamentary elements are closer to the longitudinal axis of the cord and are able, on account of their helix, to accommodate far lower longitudinal compressive deformations than the cord according to the invention.

Second, in the case of too large a radius of curvature Rt of each strand, the cord according to the invention would have insufficient longitudinal stiffness in compression to ensure a reinforcing role, for example for tyres.

In addition, in the case of too large an internal enclosure diameter Dv, the cord would have too large a diameter relative to the diameter of the strands.

The values of the characteristics Dt, Dv and Rt and of the other characteristics described below are measured on or determined from cords either directly after they have been manufactured, that is to say before any step of embedding in an elastomer matrix, or once they have been extracted from an elastomer matrix, for example of a tyre, and have thus undergone a cleaning step during which any elastomer matrix is removed from the cord, in particular any material present inside the cord. In order to ensure an original state, the adhesive interface between each metal filamentary element and the elastomer matrix has to be eliminated, for example by way of an electrochemical process in a bath of sodium carbonate. The effects associated with the shaping step of the method for manufacturing the tyre that are described below, in particular the elongation of the cords, are eliminated by the extraction of the ply and of the cord which, during extraction, substantially regain their characteristics from before the shaping step.

The enclosure of the cord according to the invention is delimited by the strands and corresponds to the volume delimited by a theoretical circle that is, on the one hand, radially on the inside of each strand and, on the other hand, tangent to each strand. The diameter of this theoretical circle is equal to the enclosure diameter Dv.

The helix angle of each strand $\alpha e$ is a parameter well known to those skilled in the art and can be determined using the following calculation: $\tan \alpha e=2\times\pi\times Re/Pe$, in which formula Pe is the pitch expressed in millimetres at which each strand is wound, Re is the radius of the helix of each strand, expressed in millimetres, and tan refers to the tangent function. $\alpha e$ is expressed in degrees.

The helix diameter De, expressed in millimetres, is calculated using the relationship $De=Pe\times Tan(\alpha e)/\pi$, in which Pe is the pitch expressed in millimetres at which each strand is wound, $\alpha e$ is the helix angle of each strand determined above, and Tan is the tangent function. The helix diameter De corresponds to the diameter of the theoretical circle passing through the centres of the strands of the layer in a plane perpendicular to the main axis of the cord.

The enclosure diameter Dv, expressed in millimetres, is calculated using the relationship $Dv=De-Dt$, in which Dt is the diameter of each strand and De is the helix diameter, both expressed in millimetres.

The radius of curvature Rt, expressed in millimetres, is calculated using the relationship $Rt=Pe/(\pi\times Sin(2\alpha e))$, in which Pe is the pitch expressed in millimetres of each strand, $\alpha e$ is the helix angle of each internal strand, and Sin is the sine function.

It will be recalled that the pitch at which each strand is wound is the length covered by this filamentary element, measured parallel to the axis of the cord in which it is located, after which a strand that has this pitch makes a complete turn about said axis of the cord.

Advantageously, the cord is such that the metal filamentary elements define an internal enclosure for the strand of diameter Dvt, each metal filamentary element having a diameter Df and a helix radius of curvature Rf, defined by $Rf=P/(\pi\times Sin(2\alpha))$ where P is the pitch of each metal filamentary element expressed in millimetres and $\alpha$ is the helix angle of each metal filamentary element (F1), Dvt, Df and Rf being expressed in millimetres, the cord satisfying the following relationships: $9\leq Rf/Df\leq 30$, and $1.30\leq Dvt/Df\leq 4.50$.

The enclosure of each strand is delimited by the metal filaments and corresponds to the volume delimited by a theoretical circle that is, on the one hand, radially on the inside of each metal filamentary element and, on the other hand, tangent to each metal filamentary element. The diameter of this theoretical circle is equal to the enclosure diameter Dvt.

The helix angle of each metal filamentary element a is a parameter well known to those skilled in the art and can be determined using the following calculation: $\tan \alpha=2\times\pi\times R/P$, in which formula P is the pitch expressed in millimetres at which each strand is wound, R is the radius of the helix of each strand, expressed in millimetres, and tan refers to the tangent function. $\alpha$ is expressed in degrees.

The helix diameter Dh, expressed in millimetres, is calculated using the relationship $Dh=P\times Tan(\alpha)/\pi$, in which P is the pitch expressed in millimetres at which each metal filamentary element is wound, $\alpha$ is the helix angle of each metal filamentary element as determined above, and Tan is the tangent function. The helix diameter Dh corresponds to the diameter of the theoretical circle passing through the centres of the metal filamentary elements of the layer in a plane perpendicular to the main axis of the cord.

The enclosure diameter for the strand, Dvt, expressed in millimetres, is calculated using the relationship $Dvt=Dh-Df$, in which Df is the diameter of each metal filamentary element and Dh is the helix diameter, both expressed in millimetres.

The radius of curvature Rf, expressed in millimetres, is calculated using the relationship $Rf=P/(\pi\times Sin(2\alpha))$, in which P is the pitch expressed in millimetres of each metal filamentary element, $\alpha$ is the helix angle of each metal filamentary element, and Sin is the sine function.

It will be recalled that the pitch with which each metal filamentary element is wound is the length covered by this filamentary element, measured parallel to the axis of the cord in which it is located, at the end of which the filamentary element having this pitch makes a complete turn around said axis of the cord.

The optional features described below could be combined with one another in so far as such combinations are technically compatible.

In one advantageous embodiment, all the metal filamentary elements have the same diameter Df.

Another subject of the invention is a method for manufacturing a cord comprising:

- a step of manufacturing N strands via:
  - a step of supplying a transitory assembly comprising a layer made up of M'>1 metal filaments wound in a helix around a transitory core;
  - a step of separating the transitory assembly into:
  - a first split assembly comprising a layer made up of M1'≥1 metal filament(s) wound in a helix, the M1' metal filament(s) originating from the layer made up of M'>1 metal filaments of the transitory assembly,
  - a second split assembly comprising a layer made up of M2'>1 metal filaments wound in a helix, the M2' metal filaments originating from the layer made up of M'>1 metal filaments of the transitory assembly,
  - the transitory core or one or more ensembles comprising the transitory core,
  - a step of reassembling the first split assembly with the second split assembly to form an strand having one layer of metal filaments and comprising M>1 metal filaments;
- a step of assembling the N strands by cabling to form the cord.

Each strand is manufactured in accordance with a method and by employing an installation that are described in documents WO2016083265 and WO2016083267. Such a method implementing a splitting step should be distinguished from a conventional cabling method comprising a single assembly step in which the metal filamentary elements are wound in a helix, the assembly step being preceded by a step of individually preforming each metal filamentary element in order in particular to increase the value of the structural elongation. Such methods and installations are described in documents EP0548539, EP1000194, EP0622489, WO2012055677, JP2007092259, W02007128335, JPH06346386 or EP0143767. During these methods, in order to obtain the greatest possible structural elongation, the metal monofilaments are individually preformed. However, this step of individually preforming the metal monofilaments, which requires a particular installation, not only makes the method relatively unproductive compared with a method without an individual preforming step, without otherwise making it possible to achieve great structural elongations, but also has a negative impact on the metal monofilaments preformed in this way on account of the rubbing against the preforming tools. Such a negative impact creates rupture initiators at the surface of the metal monofilaments and is therefore detrimental to the endurance of the metal monofilaments, in particular to their endurance under compression. The absence or the presence of such preforming marks is observable under an electron microscope after the manufacturing method, or more simply by knowing the method used for manufacturing the cord.

On account of the method used, each metal filamentary element of the cord is without a preforming mark. Such preforming marks include in particular flats. The preforming marks also include cracks extending in planes of section substantially perpendicular to the main axis along which each metal filamentary element extends. Such cracks extend, in a plane of section substantially perpendicular to the main axis, from a radially external surface of each metal filamentary element radially towards the inside of each metal filamentary element. As described above, such cracks are initiated by the mechanical preforming tools on account of the bending loads, that is to say perpendicularly to the main axis of each metal filamentary element, making them highly detrimental to endurance. By contrast, in the method described in WO2016083265 and WO2016083267, in which the metal filamentary elements are preformed collectively and simultaneously on a transitory core, the preforming loads are exerted in torsion and therefore not perpendicularly to the main axis of each metal filamentary element. Any cracks created do not extend radially from the radially external surface of each metal filamentary element radially towards the inside of each metal filamentary element but along the radially external surface of each metal filamentary element, making them less detrimental to endurance.

Advantageously, the cord has a diameter D such that $D \leq 6.00$ mm and preferably, $D \leq 5.00$ mm.

The diameter or apparent diameter, denoted D, is measured trapping the cord between two perfectly rectilinear rods of length 200 mm and measuring the space into which the cord is driven using the comparator described below. Reference may be made, by way of example, to the KAEFER model JD50/25 which is able to achieve a precision of 1/100 of a millimetre, is equipped with a type a contact, and has a contact pressure of around 0.6 N. The measurement protocol consists of three repetitions of a series of three measurements (taken perpendicular to the axis of the cord and under zero tension).

In one embodiment, each metal filamentary element comprises a single metal monofilament. Here, each metal filamentary element is advantageously made up of a metal monofilament. In a variant of this embodiment, the metal monofilament is directly coated with a layer of a metallic coating comprising copper, zinc, tin, cobalt or an alloy of these metals, for example brass or bronze. In this variant, each metal filamentary element is then made up of the metal monofilament, made for example of steel, forming a core, which is directly coated with the metallic coating layer.

In this embodiment, each metal elementary monofilament is, as described above, preferably made of steel, and has a mechanical strength ranging from 1000 MPa to 5000 MPa. Such mechanical strengths correspond to the steel grades commonly encountered in the field of tyres, namely the NT (Normal Tensile), HT (High Tensile), ST (Super Tensile), SHT (Super High Tensile), UT (Ultra Tensile), UHT (Ultra High Tensile) and MT (Mega Tensile) grades, the use of high mechanical strengths potentially allowing improved reinforcement of the matrix in which the cord is intended to be embedded and lightening of the matrix reinforced in this way.

Advantageously, the layer is made up of N strands wound in a helix, N ranges from 2 to 6.

The process of assembling the N strands is carried out by cabling. What is meant by cabling is that the strands do not experience any torsion about their own axis, due to a synchronous rotation before and after the point of assembly. This has the main advantage of increasing the ductility of the cords but also of achieving a breaking force which is greater than those of the open-cord strands alone.

In a first embodiment allowing partial reassembly of the M' metal filamentary elements, the separation step and the reassembly step are performed such that $M1'+M2'<M'$.

In a second embodiment allowing total reassembly of the M' metal filamentary elements, the separation step and the reassembly step are performed such that $M1'+M2'=M'$.

The advantageous features described below apply equally to the method of the first and second embodiments as described above.

As a preference, $M=M1'+M2'$ ranges from 3 to 18 and preferably from 4 to 15.

Advantageously, in order to facilitate the extraction of the transitory core in the embodiments in which the transitory core is separated into two parts each going with the first and second split assemblies:

$M1'=1$, 2 or 3 and $M2'=1$, 2 or 3 in instances in which $M'=4$ or $M'=5$ and $M1' \leq 0.75 \times M'$ in instances in which $M' \geq 6$.

$M2' \leq 0.75 \times M'$ in instances in which $M' \geq 6$.

To further facilitate the extraction of the transitory core in the embodiments in which the transitory core is separated into two parts each going with the first and second assemblies in instances in which $M' \geq 6$, $M1' \leq 0.70 \times M'$ and $M2' \leq 0.70 \times M'$.

Very preferentially, the step of providing the transient assembly comprises a step of assembling by twisting the $M'>1$ metal filamentary elements helically wound around the transitory core.

Advantageously, the step of supplying the transitory assembly comprises a step of balancing the transitory assembly. Thus, since the balancing step is performed on the transitory assembly comprising the M' metal filamentary elements and the transitory core, the balancing step is implicitly performed upstream of the step of separation into the first and second split assemblies. This avoids the need to manage the residual twist imposed during the step of assembling the transitory assembly in the path followed by the various assemblies downstream of the assembly step, notably through the guide means, for example the pulleys.

Advantageously, the method comprises a step of balancing the final assembly downstream of the reassembly step.

Advantageously, the method comprises a step of maintaining the rotation of the final assembly around its direction of travel. This rotation maintenance step is carried out downstream of the step of separating the transitory assembly and upstream of the step of balancing the final assembly.

Preferably, the method does not comprise steps of individually preforming each of the metal filamentary elements. In the methods of the prior art which use a step of individually preforming each of the metal filamentary elements, the latter are provided with a shape by preforming tools, for example rollers, these tools creating defects on the surface of the metal filamentary elements. These defects notably reduce the endurance of the metal filamentary elements and therefore of the final assembly.

Very preferably, the transitory core is a metal filamentary element. In a preferred embodiment, the transitory core is a metal monofilament. The diameter of the space between the metal filamentary elements, and therefore the geometrical characteristics of the final assembly, are accordingly controlled very precisely, in contrast to a transitory core made of a textile material, for example a polymer material, the compressibility of which can cause variations in the geometrical characteristics of the final assembly.

In other equally advantageous embodiments, the transitory core is a textile filamentary element. Such a textile filamentary element comprises at least one multifilament textile ply or, in a variant, is composed of a textile monofilament. The textile filaments that can be used are selected from polyesters, polyketones, aliphatic or aromatic polyamides and mixtures of textile filaments made of these materials. This then reduces the risks of breakage of the transitory core which are brought about by the rubbing of the metal filamentary elements against the transitory core and by the torsion imposed on the transitory core.

Reinforced Product According to the Invention

A further subject of the invention is a reinforced product comprising a polymer matrix and at least one extracted cord as defined above.

Advantageously, the reinforced product comprises one or several cords according to the invention embedded in the polymer matrix and, in the case of several cords, the cords are arranged side-by-side in a main direction.

Tyre According to the Invention

A further subject of the invention is a tyre comprising at least one extracted cord as defined hereinabove or a reinforced product as defined hereinabove.

Preferably, the tyre has a carcass reinforcement anchored in two beads and surmounted radially by a crown reinforcement which is itself surmounted by a tread, the crown reinforcement being joined to said beads by two sidewalls, and comprising at least one cord as defined above.

In one preferred embodiment, the crown reinforcement comprises a protective reinforcement and a working reinforcement, the working reinforcement comprising at least one cord as defined hereinabove, the protective reinforcement being interposed radially between the tread and the working reinforcement.

The cord is most particularly intended for industrial vehicles selected from heavy vehicles such as "heavy-duty vehicles"—i.e. underground trains, buses, road haulage vehicles (lorries, tractors, trailers), off-road vehicles—agricultural vehicles or construction plant vehicles, or other transport or handling vehicles.

As a preference, the tyre is for a vehicle of the construction plant type. Thus, the tyre has a size in which the diameter, in inches, of the seat of the rim on which the tyre is intended to be mounted is greater than or equal to 30 inches.

The invention also relates to a rubber item comprising an assembly according to the invention, or an impregnated assembly according to the invention. What is meant by a rubber item is any type of item made of rubber, such as a ball, a non-pneumatic object such as a non-pneumatic tyre casing, a conveyor belt or a caterpillar track.

A better understanding of the invention will be obtained on reading the examples which will follow, given solely by way of non-limiting examples and made with reference to the drawings, in which.

EXAMPLE OF A TYRE ACCORDING TO THE INVENTION

Figure 1:
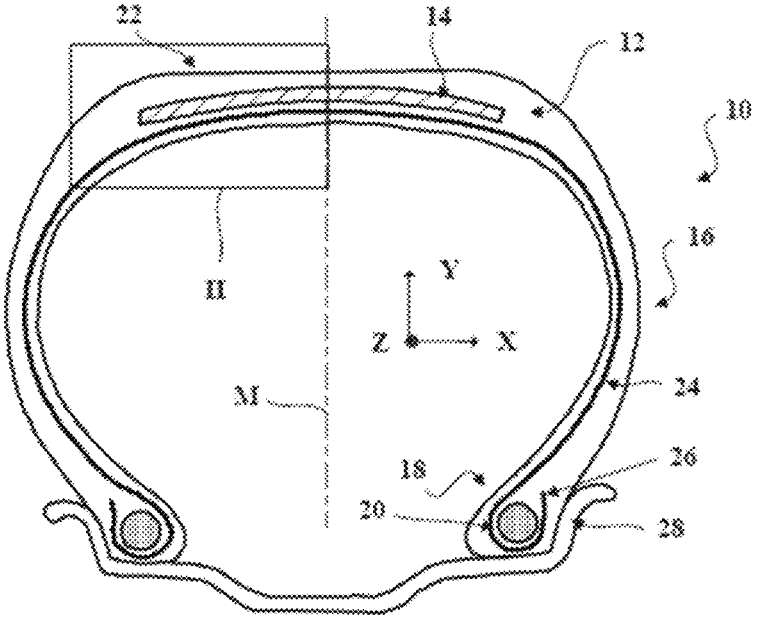
FIG. 1 is a view in cross section perpendicular to the circumferential direction of a tyre according to the invention.
Figure 2:
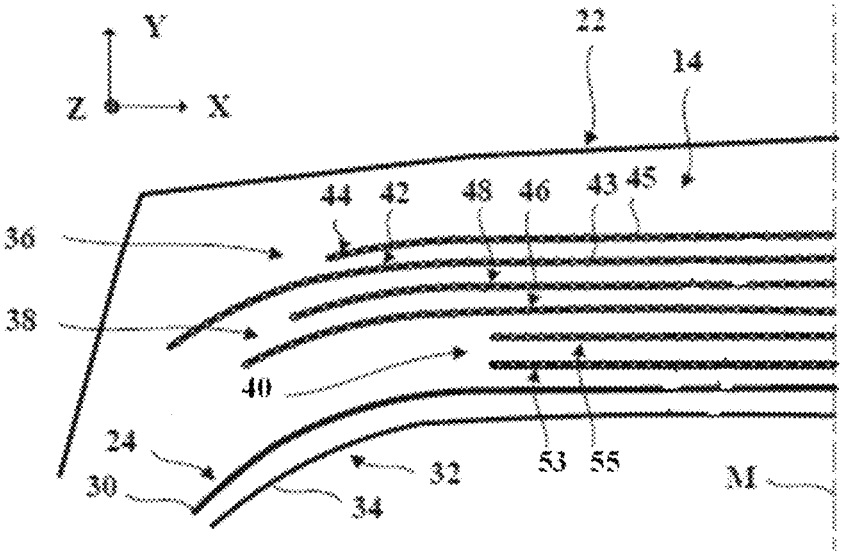
FIG. 2 is a detail view of the region II of FIG. 1.

A frame of reference X, Y, Z corresponding to the usual respectively axial (X), radial (Y) and circumferential (Z) orientations of a tyre has been depicted in FIGS. 1 and 2.

The "median circumferential plane" M of the tyre is the plane that is normal to the axis of rotation of the tyre and that is located equidistantly from the annular reinforcement structures of each bead.

FIGS. 1 and 2 depict a tyre according to the invention and denoted by the general reference P.

The tyre P is for a heavy vehicle of construction plant type, for example of "dumper" type. Thus, the tyre P has a dimension of the type 53/80R63.

The tyre P has a crown 12 reinforced by a crown reinforcement 14, two sidewalls 16 and two beads 18, each of these beads 18 being reinforced with an annular structure, in this instance a bead wire 20. The crown reinforcement 14 is surmounted radially by a tread 22 and connected to the beads 18 by the sidewalls 16. A carcass reinforcement 24 is anchored in the two beads 18 and is in this instance wound around the two bead wires 20 and comprises a turnup 26 positioned towards the outside of the tyre 20, which is shown here fitted onto a wheel rim 28. The carcass reinforcement 24 is surmounted radially by the crown reinforcement 14.

The carcass reinforcement 24 comprises at least one carcass ply 30 reinforced by radial carcass cords (not depicted). The carcass cords are positioned substantially parallel to one another and extend from one bead 18 to the other so as to form an angle comprised between 80° and 90° with the median circumferential plane M (plane perpendicular to the axis of rotation of the tyre which is situated midway between the two beads 18 and passes through the middle of the crown reinforcement 14).

The tyre P also comprises a sealing ply 32 made up of an elastomer (commonly known as "inner liner") which defines the radially internal face 34 of the tyre P and which is intended to protect the carcass ply 30 from the diffusion of air coming from the space inside the tyre P.

The crown reinforcement 14 comprises, radially from the outside towards the inside of the tyre P, a protective reinforcement 36 arranged radially on the inside of the tread 22, a working reinforcement 38 arranged radially on the inside of the protective reinforcement 36 and an additional reinforcement 40 arranged radially on the inside of the working reinforcement 38. The protective reinforcement 36 is thus radially interposed between the tread 22 and the working reinforcement 38. The working reinforcement 38 is interposed radially between the protective reinforcement 36 and the additional reinforcement 40.

The protective reinforcement 36 comprises first and second protective plies 42, 44 comprising protective metal cords, the first ply 42 being arranged radially on the inside of the second ply 44. Optionally, the protective metal cords make an angle at least equal to 10°, preferably in the range from 10° to 35° and preferentially from 15° to 30°, with the circumferential direction Z of the tyre.

The working reinforcement 38 comprises first and second working plies 46, 48, the first ply 46 being arranged radially on the inside of the second ply 48. Each ply 46, 48 comprises at least one cord 50. Optionally, the working metal cords 50 are crossed from one working ply to the other and make an angle at most equal to 60°, preferably in the range from 15° to 40°, with the circumferential direction Z of the tyre.

The additional reinforcement 40, also referred to as a limiting block, the purpose of which is to absorb in part the mechanical stresses of inflation, comprises, for example and as known per se, additional metal reinforcing elements, for example as described in FR 2 419 181 or FR 2 419 182, making an angle at most equal to 10°, preferably in the range from 5° to 10°, with the circumferential direction Z of the tyre P.

Example of a Reinforced Product According to the Invention

Figure 3:
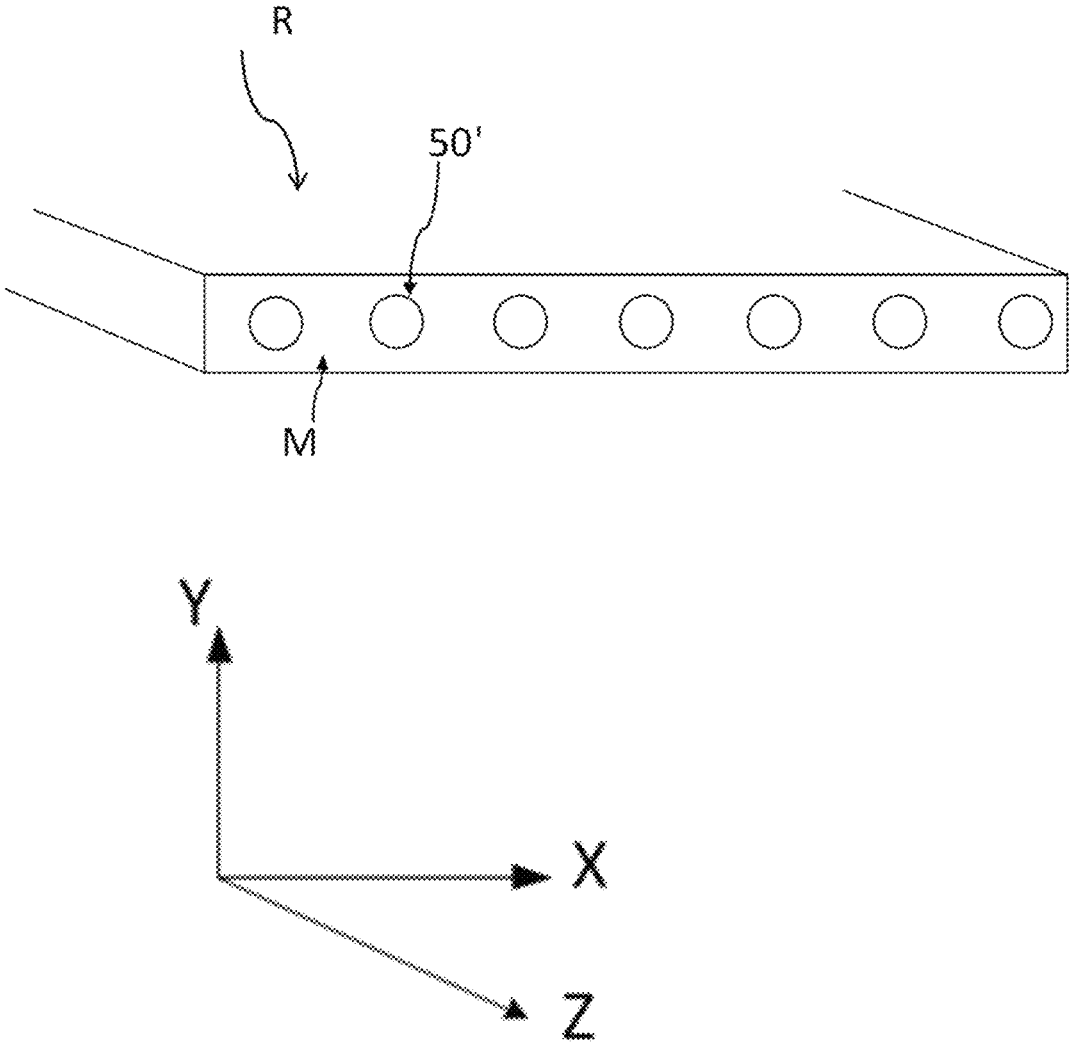
FIG. 3 is a view in cross section of a reinforced product according to the invention.

FIG. 3 depicts a reinforced product according to the invention and denoted by the general reference R. The reinforced product R comprises at least one cord 50', in this instance several cords 50', embedded in the polymer matrix Ma.

FIG. 3 depicts the polymer matrix Ma, the cords 50' in a frame of reference X, Y, Z, in which the direction Y is the radial direction and the directions X and Z are the axial and circumferential directions. In FIG. 3, the reinforced product R comprises several cords 50' arranged side-by-side in the main direction X and extending parallel to one another within the reinforced product R and collectively embedded in the polymer matrix Ma.

In this instance, the polymer matrix Ma is an elastomer matrix based on an elastomer compound.

Cord According to a First Embodiment of the Invention

Figure 5:
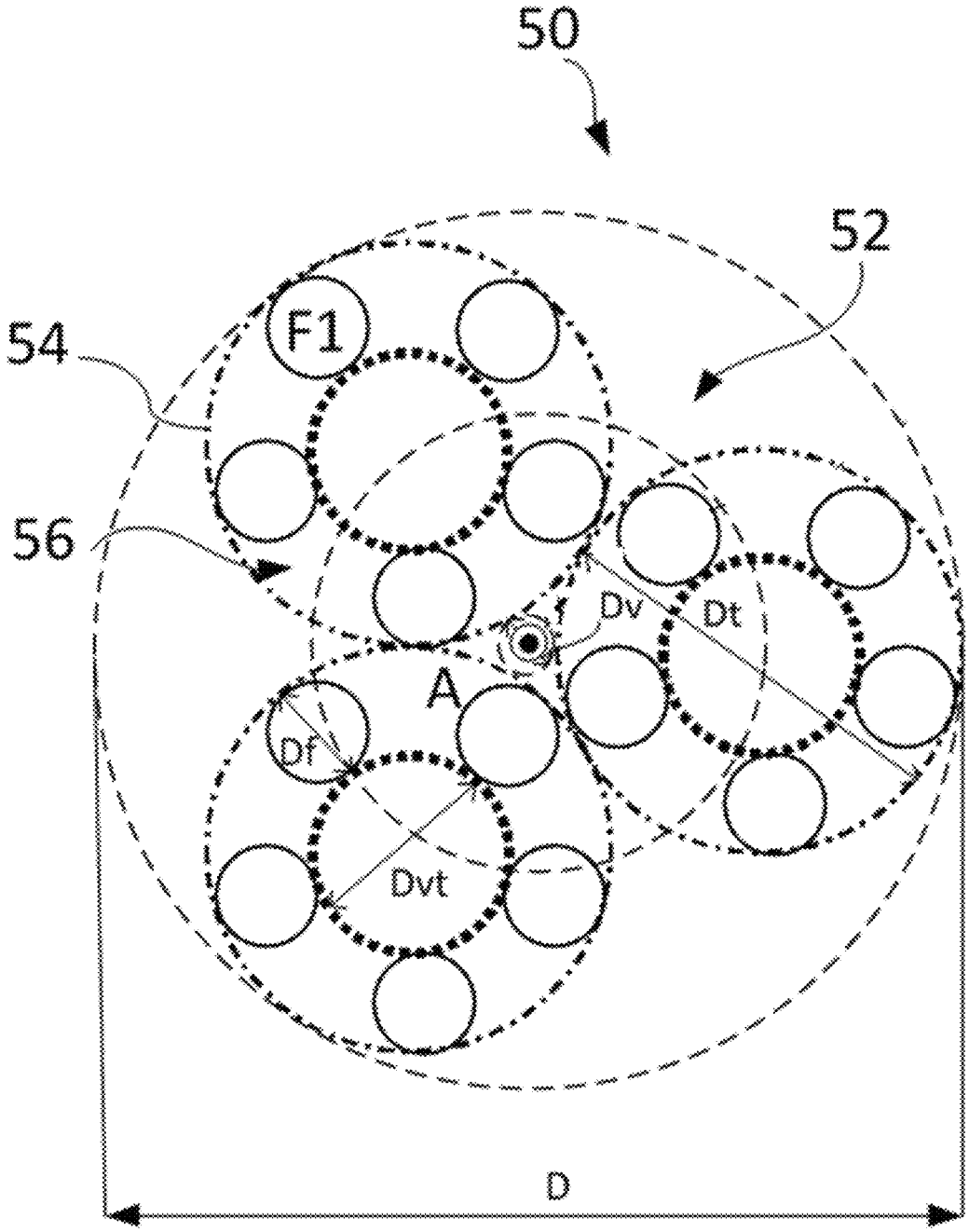
FIG. 5 is a schematic view in cross section perpendicular to the axis of the cord (which is assumed to be straight and at rest) of a cord (50) according to a first embodiment of the invention.

FIG. 5 depicts the cord 50 according to a first embodiment of the invention.

Each protective reinforcing element 43, 45 and each hoop reinforcing element 53, 55 is formed, once it has been extracted from the tyre 10, of an extracted cord 50' as described below. The cord 50 is obtained by embedding in a polymer matrix, in this instance in a polymer matrix respectively forming each polymer matrix of each protective ply 42, 44 and of each hoop layer 52, 54 in which the protective reinforcing elements 43, 45 and the hoop reinforcing elements 53, 55 are respectively embedded.

The cord 50 and the extracted cord 50' are made of metal having a single layer.

The cord 50 or the cord 50' comprises a layer of 1×N structure comprising a single layer 52 of N=3 strands 54 wound in a helix about a main axis (A), each strand 54 having one layer 56 of metal filaments F1 and comprising M>1 metal filaments wound in a helix about an axis (B), with in this instance M=5.

As described above, the value At is determined by plotting a force-elongation curve for the cord 50, by applying the standard ASTM D2969-04 of 2014.

The cord 50 has a total elongation At>8.10%, preferably At≥8.30% and more preferentially At≥8.50% and the total elongation At≤20.00% and preferably At≤16.00%, in this instance At=13.4%.

Figure 4:
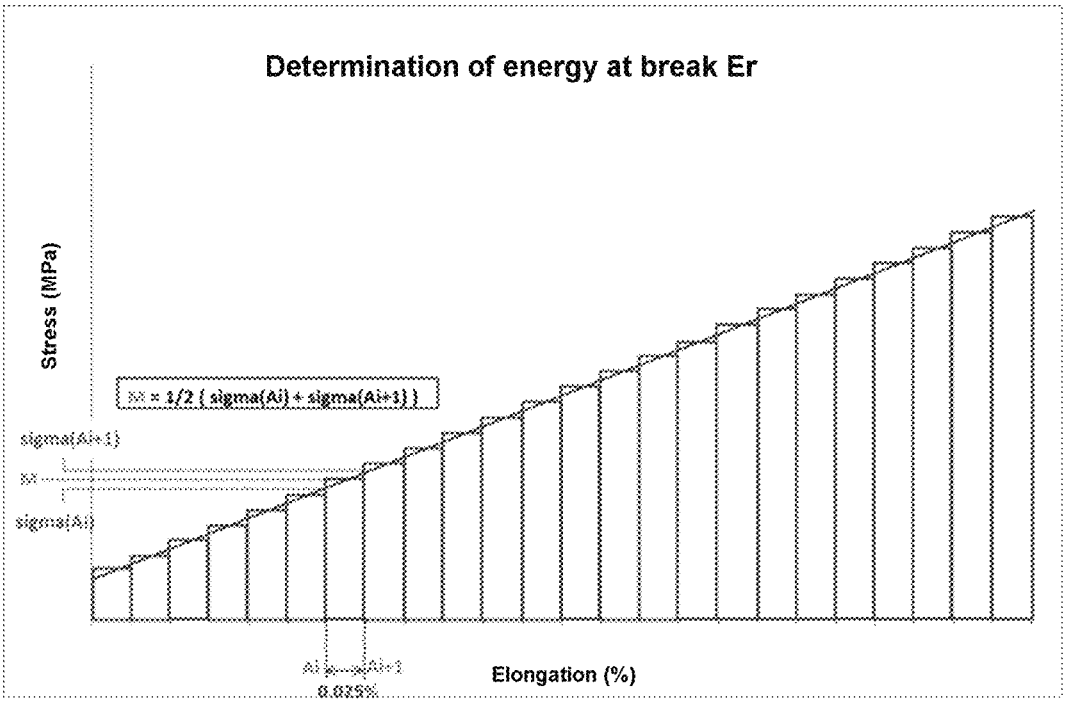
FIG. 4 illustrates part of the stress-elongation curve for a cord (50) according to the invention.

As described hereinabove, from this stress-elongation curve, the area under this curve is deduced. FIG. 4 depicts the rectangle method for determining the energy-at-break indicator for the cord 50.

The energy-at-break indicator Er for the cord 50 is such that $Er=\int_0^{At}\sigma(Ai)\times dAi$ which is substantially equal to $\Sigma_{0\%}^{13.4\%}\frac{1}{2}(\sigma(Ai)+\sigma(Ai+1))\times 0.025\%=89\ MJ/m^3$, which is strictly greater than 52 $MJ/m^3$, preferably greater than or equal to 55 $MJ/m^3$ and less than or equal to 200 $MJ/m^3$ and preferably less than or equal to 150 $MJ/m^3$.

The cord 50 has a structural elongation As such that As>4.30%, preferably As≥4.50% and more preferentially As≥4.60% and such that As≤10.0% and preferably As≤9.50%. In this instance As=9.3%.

The cord 50 has a secant modulus E1 ranging from 3.0 to 10.0 GPa and preferably ranging from 3.5 to 8.5 GPa. In this instance E1=4.0 GPa.

The cord 50 has a tangent modulus E2 ranging from 50 to 180 GPa and preferably from 55 to 150 GPa. In this instance, E2=73 GPa.

The extracted cord 50' has a total elongation At'>5.00% and preferably At'≥5.20%. In this instance At'=10%.

The energy-at-break indicator Er' for the extracted cord 50' is such that $Er'=\int_0^{At'}\sigma(Ai)\times dAi$ which is substantially equal to $\Sigma_{0\%}^{10.0\%}\frac{1}{2}(\sigma(Ai)+\sigma(Ai+1))\times 0.025\%=82\ MJ/m^3$, which is strictly greater than 35 $MJ/m^3$, preferably greater than or equal to 40 $MJ/m^3$.

The strands 54 define an internal enclosure 59 of the cords 50; 50' of diameter Dv, each strand 54 having a diameter Dt and having a helix radius of curvature Rt defined by $Rt=Pe/(\pi\times Sin(2\alpha e))=80/(\pi\times sin(2\times 5.3\times\pi/180)=138$ mm.

Rt/Dt=138/2.03=68≤180 and 68≥25.

Dv/Dt=0.32/2.03=0.16≤0.50 and 0.16≥0.10.

The metal filamentary elements F1 of each strand 52 define an internal enclosure 58 of the strand 52 of diameter Dvt, each metal filamentary element F1 has a diameter Df and has a helix radius of curvature Rf defined by $Rf=P/(\pi\times Sin(2\alpha))=10.4/(\pi\times sin(2\times 25.8\times\pi/180)=4.2$ mm.

Rf/Df=4.2/0.46=9≤30.

Dvt/Df=1.12/0.46=2.46≤4.50 and 2.46≥1.30.

Method for Manufacturing the Cord According to the Invention

Figure 8:
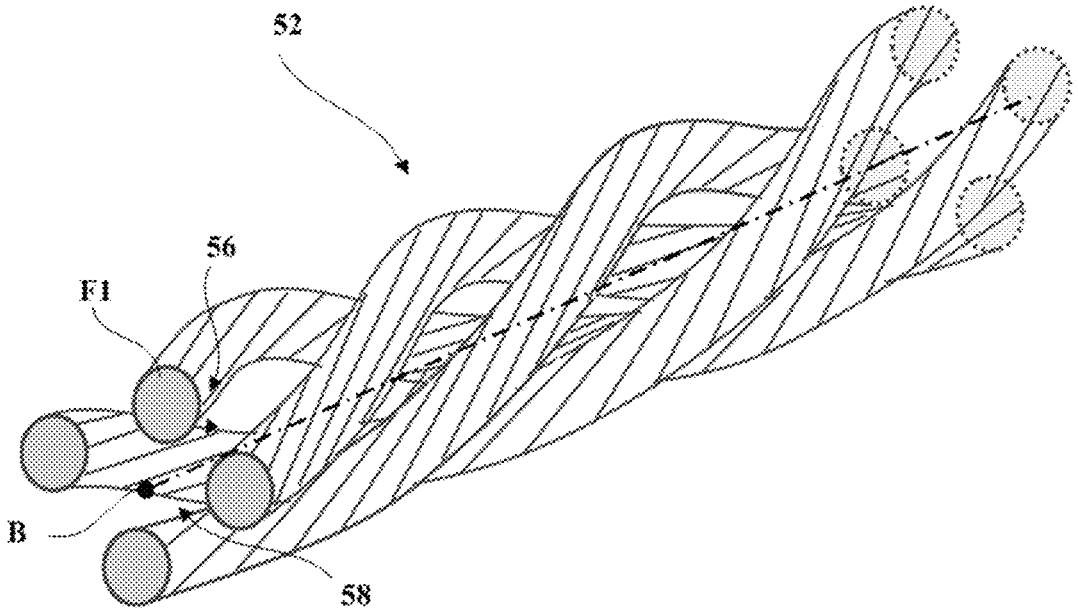
FIGS. 8 and 9 are schematic depictions of the method according to the invention allowing the manufacture of the cord (50) of FIG. 5.
Figure 9:
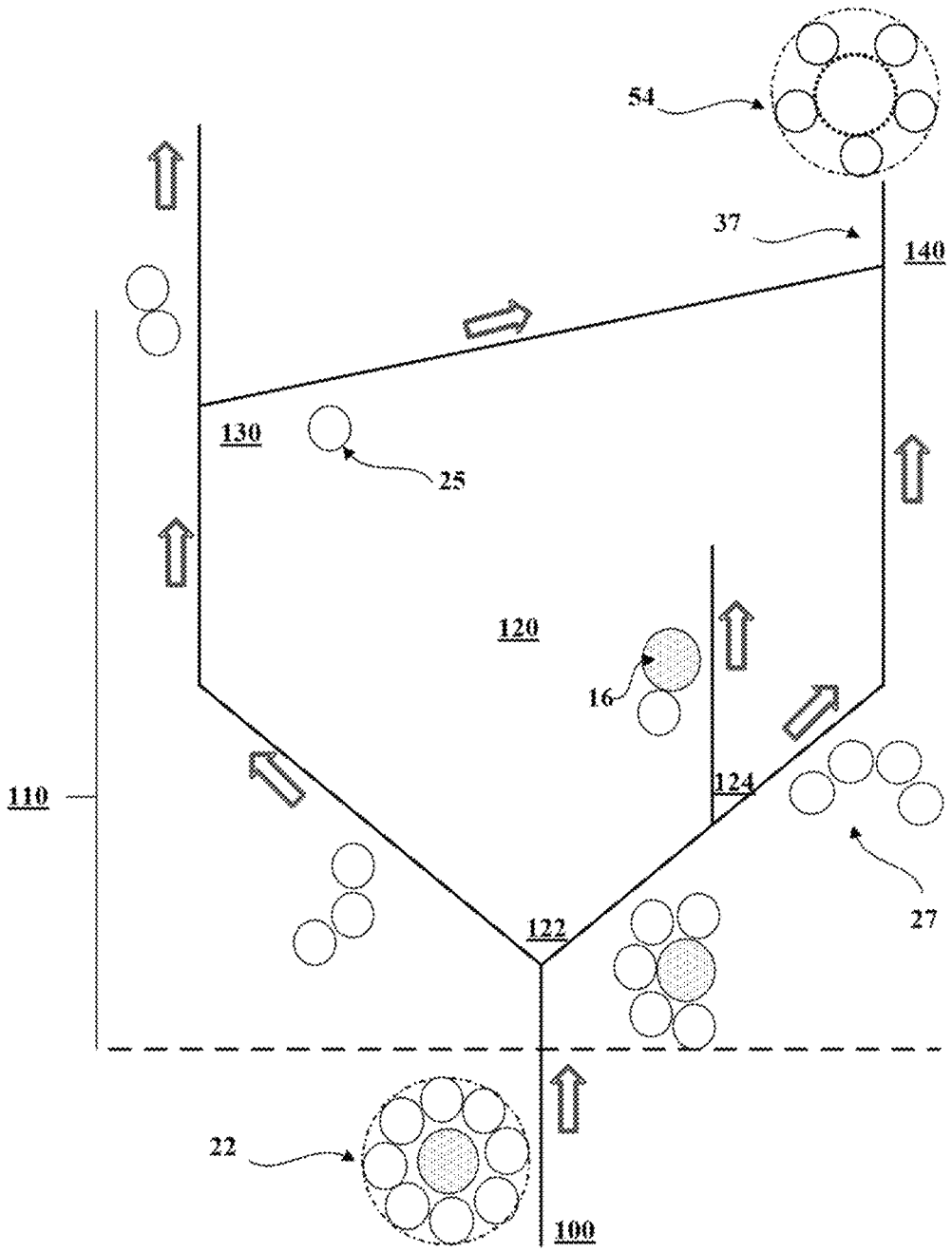

An example of a method for the manufacture of the multi-strand cord 50 as depicted in FIGS. 8 and 9 will now be described.

First of all, the filamentary elements F1 and the transitory core 16 are unwound from the supply means.

Next, the method comprises a step 100 of supplying the transitory assembly 22 comprising, on the one hand, a step of assembly by twisting the M' metal filamentary elements F1 in a single layer of M' metal filamentary elements F1 around the transitory core 16 and, on the other hand, a step of balancing the transitory assembly 22 carried out by means of a twister.

The method comprises a step 110 of separating the transitory assembly 22 into the first split assembly 25, the second split assembly 27 and the transitory core 16 or one or more ensembles comprising the transitory core 16, in this case the transitory core 16.

Downstream of the supply means 11, the step 110 of separating the transitory assembly 22 into the first split assembly 25, the second split assembly 27 and the transitory core 16 comprises a step 120 of separating the transitory assembly 22 into the precursor ensemble, the second split assembly 27 and finally the transitory core 16.

Downstream of the separation step 122, the step 120 of separating the transitory assembly into the precursor ensemble and the split ensemble comprises a step 124 of separating the split ensemble into the second split assembly 27 and the transitory core 16. In this case, the separation step 124 comprises a step of splitting the split ensemble into the second split assembly 27, the transitory core 16 and the complementary ensemble.

Downstream of the supply step 100, the step 110 of separating the transitory assembly into the first split assembly 25, the second split assembly 27 and the transitory core 16 comprises a step 130 of separating the precursor ensemble into the first split assembly 25 and the complementary ensemble.

Downstream of the separation steps 110, 120, 124 and 130, the method comprises a step 140 of reassembling the first split assembly 25 with the second split assembly 27 to form the strand 54. In this embodiment, the reassembly step 140 is a step of reassembling the first split assembly 25 with the second split assembly 27 to form the strand 54 and comprising M>1 metal filaments F1, where M ranges from 3 to 18 and preferably from 4 to 15, and here M=5.

In this embodiment, the supply step 100, the separation step 110 and the reassembly step 140 are carried out so that all the M' metal filamentary elements F1 have the same diameter Dfi, are helically wound at the same pitch P and have the same helix radius of curvature Rf that are described above.

In this embodiment allowing a partial reassembly of the M' metal filamentary elements, the separation step 110 and the reassembly step 140 are carried out so that M1'+M2'<M'. Here, M1'=1 and M2'=4: M1'+M2'=5<8. It will finally be noted that M1'≤0.70×M'=0.70×8=5.6 and M2'≤0.70×M'=0.70×8=5.6.

A final balancing step is performed.

Finally, the strand 54 is stored on a storage spool. N strands 54 are manufactured in the same way.

As regards the transitory core 16, the method comprises a step of recycling the transitory core 16. During this recycling step, the transitory core 16 is recovered downstream of the separation step 110, in this case downstream of the separation step 124, and the transitory core 16 previously recovered is introduced upstream of the assembly step. This recycling step is continuous.

It will be noted that the method thus described does not have steps of individually preforming each of the metal filamentary elements F1.

Figure 10:
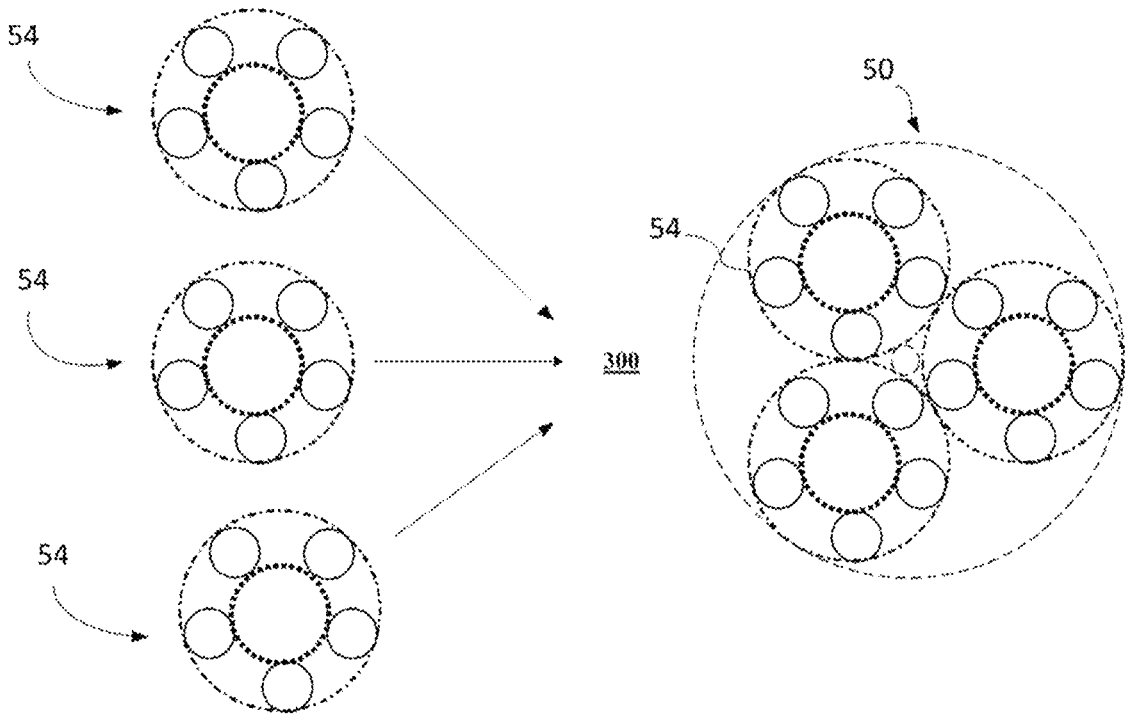
FIG. 10 illustrates the assembly of the cord (50).

An assembly step 300 is performed that involves assembling the N strands 54 by cabling to form the cord 50. In this instance N=3. See FIG. 10.

It will be noted that the method thus described does not have steps of individually preforming each of the strands 54.

Cord According to a Second Embodiment of the Invention

Figure 6:
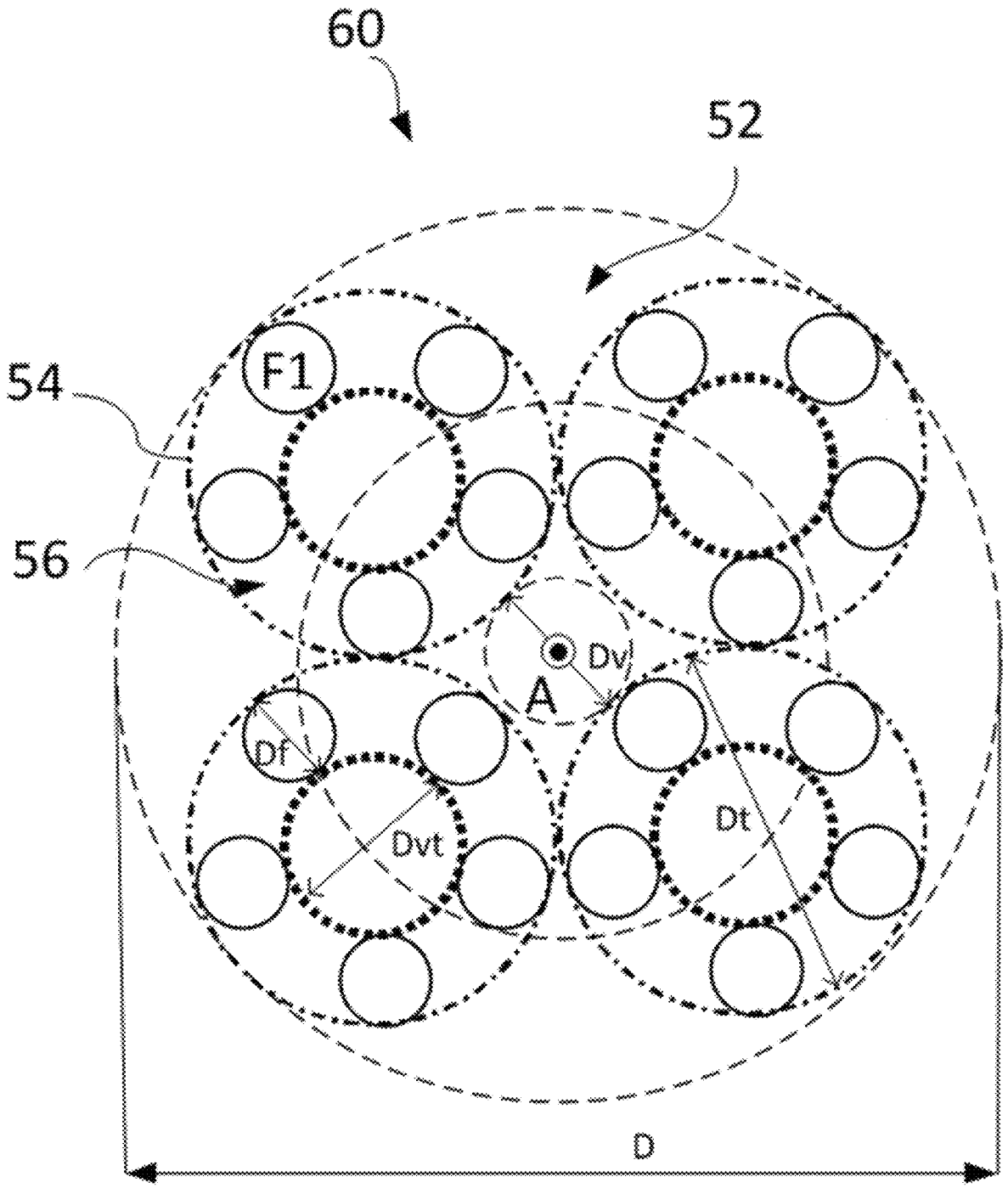
FIG. 6 is a view similar to that of FIG. 5 of a cord (60) according to a second embodiment of the invention.
Figure 7:
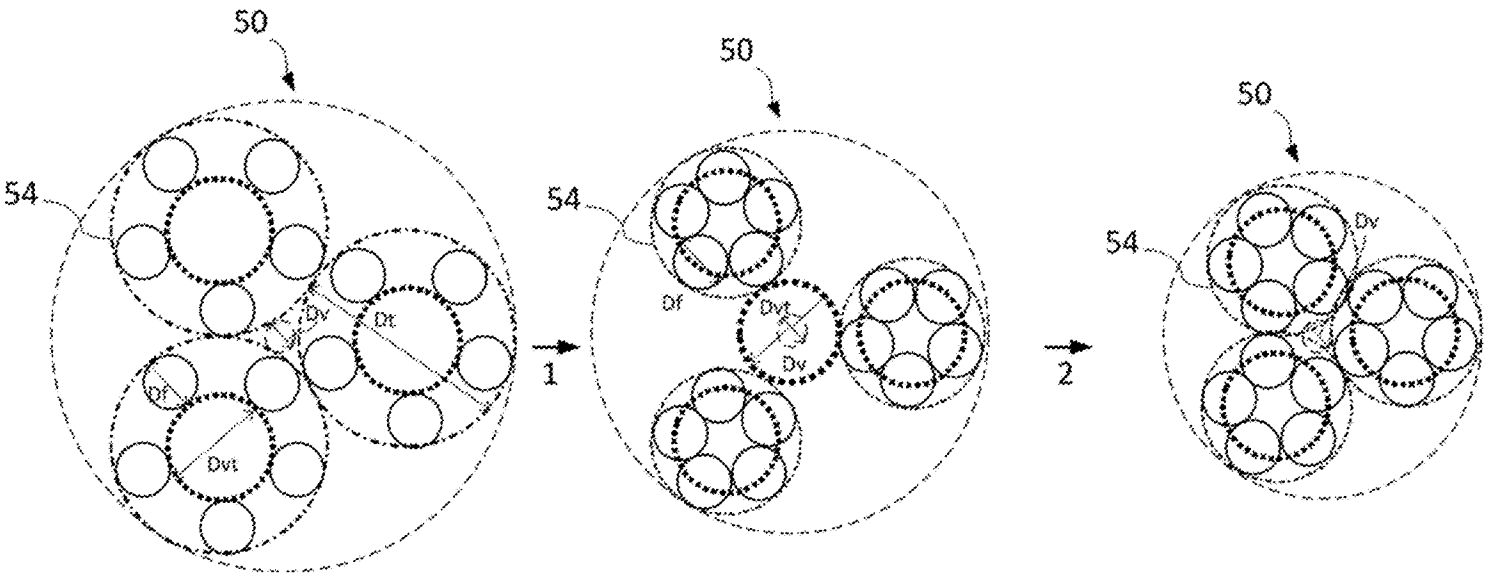
FIG. 7 is a schematic depiction of the effect of the deformability of the cord (50) of FIG. 5 under light tensile load thanks to the radial clearance of the filaments.

FIG. 6 depicts the cord 60 according to a second embodiment of the invention.

Unlike in the first embodiment described hereinabove, the cord 60 according to the second embodiment is such that N=4.

The characteristics of the various cords 50, 50', 60, 60', 51, 52, 53, 53', 54 according to the invention and of the cords of the prior art EDT1, EDT1', EDT2 and EDT2' are summarized in Tables 1, 2 and 3 below.

Comparative Tests

Evaluation of the Total Elongation and of the Enemy-at-Break Indicator for the Cords The stress-elongation curves for the cords were plotted by applying the standard ASTM D2969-04 of 2014, and the total elongation and the energy-at-break indicator for the various cords 50, 50', 60, 60', 51, 52, 53, 53', 54 according to the invention and for the cords EDT1, EDT1', EDT2 and EDT2' of the prior art were calculated.

In Table 3, "NA" signifies that the parameter has not been measured.

TABLE 1

| Cords | 50 | 50' | 60 | 60' |
|---|---|---|---|---|
| N/direction of cord | 3/S | 3/S | 4/Z | 4/Z |
| direction of strand 54 | S | S | S | S |
| M' | 8 | 8 | 8 | 8 |
| M | 5 | 5 | 5 | 5 |
| Rf (mm) | 4.2 | 4.2 | 4.2 | 4.2 |
| P (mm) | 10.4 | 10.4 | 10.4 | 10.4 |
| α (°) | 25.8 | 25.8 | 25.8 | 25.8 |
| Df (mm) | 0.46 | 0.46 | 0.46 | 0.46 |
| Dvt (mm) | 1.12 | 1.12 | 1.12 | 1.12 |
| Rf/Df | 9 | 9 | 9 | 9 |
| Dvt/Df | 2.46 | 2.46 | 2.46 | 2.46 |
| Rt (mm) | 138 | 138 | 113 | 113 |
| Pe (mm) | 80 | 80 | 80 | 80 |
| αe (°) | 5.3 | 5.3 | 6.5 | 6.5 |
| Dt (mm) | 2.03 | 2.03 | 2.03 | 2.03 |
| Dv (mm) | 0.32 | 0.32 | 0.86 | 0.86 |
| Rt/Dt | 68 | 68 | 56 | 56 |
| Dv/Dt | 0.16 | 0.16 | 0.42 | 0.42 |
| E1 (GPa) | 4.0 | — | 3.8 | — |
| ML (g/m) | 21.3 | 21.3 | 28.5 | 28.5 |
| E2 (GPa) | 73 | 39 | 59 | 33 |
| At % | 13.4 | — | 13.8 | — |
| At' % | — | 10.0 | — | 10.1 |
| Er (MJ/m$^3$) | 89 | — | 88 | — |
| Er' (MJ/m$^3$) | — | 82 | — | 83 |
| As % | 9.3 | — | 9.4 | — |
| D (mm) | 4.38 | 4.38 | 4.92 | 4.92 |

TABLE 2

| Cords | 51 | 52 | 53 | 53' | 54 |
|---|---|---|---|---|---|
| N/direction of cord | 3/Z | 3/Z | 3/Z | 3/Z | 3/Z |
| Direction of strand 54 | S | S | S | S | S |
| M' | 8 | 8 | 8 | 8 | 7 |
| M | 6 | 7 | 8 | 8 | 5 |
| Rf(mm) | 4.2 | 4.2 | 4.2 | 4.2 | 4.8 |
| P (mm) | 10.4 | 10.4 | 10.4 | 10.4 | 10.4 |
| α (°) | 25.8 | 25.8 | 25.8 | 25.8 | 21.8 |
| Df(mm) | 0.46 | 0.46 | 0.46 | 0.46 | 0.46 |
| Dvt(mm) | 1.12 | 1.12 | 1.12 | 1.12 | 0.84 |
| Rf/Df | 9 | 9 | 9 | 9 | 10 |
| Dvt/Df | 2.46 | 2.46 | 2.46 | 2.46 | 1.85 |
| Rt(mm) | 138 | 138 | 138 | 138 | 159 |
| Pe (mm) | 80 | 80 | 80 | 80 | 80 |
| αe (°) | 5.3 | 5.3 | 5.3 | 5.3 | 4.6 |
| Dt(mm) | 2.03 | 2.03 | 2.03 | 2.03 | 1.75 |
| Dv(mm) | 0.32 | 0.32 | 0.32 | 0.32 | 0.28 |
| Rt/Dt | 68 | 68 | 68 | 68 | 91 |

TABLE 2-continued

| Cords | 51 | 52 | 53 | 53' | 54 |
|---|---|---|---|---|---|
| Dv/Dt | 0.16 | 0.16 | 0.16 | 0.16 | 0.16 |
| E1 (GPa) | 3.9 | 4.3 | 8.0 | — | 7.1 |
| ML (g/m) | 25.5 | 29.4 | 33.4 | 33.4 | 20.4 |
| E2 (GPa) | 85 | 94 | 106 | 53 | 95 |
| At % | 11.9 | 8.9 | 8.5 | — | 9.0 |
| At' % | — | — | — | 5.9 | — |
| Er (MJ/m$^3$) | 82 | 63 | 56 | — | 72 |
| Er' (MJ/m$^3$) | — | — | — | 48 | — |
| As % | 7.8 | 6.0 | 4.6 | — | 5.6 |
| D (mm) | 4.38 | 4.38 | 4.38 | 4.38 | 3.78 |

TABLE 3

| Cords | EDT1 | EDT1' | EDT2 | EDT2' |
|---|---|---|---|---|
| N/direction of cord | 4/S | 4/S | 4/S | 4/S |
| Direction of strands | S | S | S | S |
| M' | — | — | — | — |
| M | 3 | 3 | 4 | 4 |
| V | 8 | 8 | 9 | 9 |
| Rf(mm) | NA | NA | NA | NA |
| P1 (mm) | 6.7 | 6.7 | 5.1 | 5.1 |
| P2 (mm) | 10 | 10 | 7.5 | 7.5 |
| α (°) | NA | NA | NA | NA |
| Df(mm) | 0.35 | 0.35 | 0.26 | 0.26 |
| Dvt(mm) | NA | NA | NA | NA |
| Rf/Df | NA | NA | NA | NA |
| Dvt/Df | NA | NA | NA | NA |
| Rt(mm) | 9 | 9 | 6.3 | 6.3 |
| Pe (mm) | 20 | 20 | 15 | 15 |
| αe (°) | 22.5 | 22.5 | 24.8 | 24.8 |
| Dt(mm) | 1.48 | 1.48 | 1.15 | 1.15 |
| Dv(mm) | 0.84 | 0.84 | 0.80 | 0.80 |
| Rt/Dt | 6.1 | 6.1 | 5.4 | 5.4 |
| Dv/Dt | 0.57 | 0.57 | 0.70 | 0.70 |
| E1 (GPa) | 1.0 | — | 1.0 | — |
| ML (g/m) | 35.8 | 35.8 | 23.1 | 23.1 |
| E2 (GPa) | 104 | 81 | 81 | 68 |
| At % | 6.0 | — | 8.1 | — |
| At' % | — | 3.4 | — | 4.7 |
| Er (MJ/m$^3$) | 44 | — | 52 | — |
| Er' (MJ/m$^3$) | — | 30 | — | 31 |
| As % | 2.8 | — | 4.3 | — |
| D (mm) | 3.80 | 3.80 | 3.10 | 3.10 |

Tables 1, 2 and 3 demonstrate that the cords 50, 50', 60, 60', 51, 52, 53, 53', 54 according to the invention have both an improved energy-at-break indicator and have better deformability in comparison with the cords of the prior art EDT1, EDT1', EDT2 and EDT2'.

Thus, the cords according to the invention are able to solve the problems mentioned in the preamble.

The invention is not limited to the above-described embodiments.

The invention claimed is:

1. A multi-strand cord having a 1×N structure comprising a single layer of N strands wound in a helix about a main axis, each strand having one layer of metal filaments and comprising M>1 metal filaments wound in a helix about an axis, wherein the multi-strand cord has a total elongation At>8.10% determined by the standard ASTM D2969-04 of 2014, and wherein an energy-at-break indicator Er of the multi-strand cord, defined by $Er=\int_0^{At}\sigma(Ai)\times dAi$, where σ(Ai) is a tensile stress in MPa measured at an elongation Ai and dAi is an elongation such that Er is strictly greater than 52 MJ/m$^3$.

2. The multi-strand cord according to claim 1, wherein the total elongation At≥8.30%.

3. The multi-strand cord according to claim 1, wherein the energy-at-break indicator Er of the multi-strand cord is greater than or equal to 55 MJ/m$^3$.

4. The multi-strand cord according to claim 1, wherein the multi-strand cord has a structural elongation As determined by the standard ASTM D2969-04 of 2014 such that As>4.30%.

5. The multi-strand cord according to claim 1, wherein the multi-strand cord has a secant modulus E1 ranging from 3.0 to 10.0 GPa.

6. The multi-strand cord according to claim 1, wherein the multi-strand cord has a tangent modulus E2 ranging from 50 to 180 GPa.

7. The multi-strand cord according to claim 1, wherein the strands define an internal enclosure of the multi-strand cord of diameter Dv, each strand having a diameter Dt and a helix radius of curvature Rt defined by Rt=Pe/(π×Sin(2αe)), where Pe is a pitch of each strand expressed in millimeters and αe is a helix angle of each strand, Dv, Dt and Rt being expressed in millimeters, the multi-strand cord satisfying the following relationships: 25≤Rt/Dt≤180 and 0.10≤Dv/Dt≤0.50.

8. The multi-strand cord according to claim 1, wherein metal filamentary elements define an internal enclosure of the strand of diameter Dvt, each metal filamentary element having a diameter Df and having a helix radius of curvature Rf defined by Rf=P/(π×Sin(2α)), where P is a pitch of each metal filamentary element expressed in millimeters and α is a helix angle of each metal filamentary element, Dvt, Df and Rf being expressed in millimeters, the multi-strand cord satisfying the following relationships: 9≤Rf/Df≤30 and 1.30≤Dvt/Df≤4.50.

9. An extracted cord extracted from a polymer matrix, the extracted cord having a 1×N structure comprising a single layer of N strands wound in a helix about a main axis, each strand having one layer of metal filaments and comprising M>1 metal filaments wound in a helix about an axis, wherein the extracted cord has a total elongation At'≥5.00% determined by the standard ASTM D2969-04 of 2014, and wherein an energy-at-break indicator Er' of the extracted cord, defined by $Er'=\int_0^{At'}\sigma(Ai)\times dAi$, where σ(Ai) is a tensile stress in MPa measured at an elongation Ai and dAi is an elongation such that Er' is strictly greater than 35 MJ/m$^3$.

10. The extracted cord according to claim 9, wherein a total elongation At' is such that At'≥5.20%.

11. The extracted cord according to claim 9, wherein the energy-at-break indicator Er' of the extracted cord is greater than or equal to 40 MJ/m$^3$.

12. The extracted cord according to claim 9, wherein the strands define an internal enclosure of the extracted cord of diameter Dv, each strand having a diameter Dt and a helix radius of curvature Rt defined by Rt=Pe/(π×Sin(2αe)), where Pe is a pitch of each strand expressed in millimeters and αe is a helix angle of each strand, Dv, Dt and Rt being expressed in millimeters, the extracted cord satisfying the following relationships: 25≤Rt/Dt≤180 and 0.10≤Dv/Dt≤0.50.

13. The extracted cord according to claim 9, wherein metal filamentary elements define an internal enclosure of the strand of diameter Dvt, each metal filamentary element having a diameter Df and having a helix radius of curvature Rf defined by Rf=P/(π×Sin(2α)), where P is a pitch of each metal filamentary element expressed in millimeters and α is a helix angle of each metal filamentary element, Dvt, Df and Rf being expressed in millimeters, the extracted cord satisfying the following relationships: $9 \leq Rf/Df \leq 30$ and $1.30 \leq Dvt/Df \leq 4.50$.

14. A method for manufacturing the multi-strand cord according to claim 1, the method comprising:

a step of manufacturing N strands via:

a step of supplying a transitory assembly comprising a layer made up of M'>1 metal filaments wound in a helix around a transitory core;

a step of separating the transitory assembly into:

a first split assembly comprising a layer made up of M1'≥1 metal filaments wound in a helix, the M1' metal filaments originating from the layer made up of M'>1 metal filaments of the transitory assembly, a second split assembly comprising a layer made up of M2'>1 metal filaments wound in a helix, the M2' metal filaments originating from the layer made up of M'>1 metal filaments of the transitory assembly, and the transitory core or one or more ensembles comprising the transitory core; and a step of reassembling the first split assembly with the second split assembly to form a strand having one layer of metal filaments and comprising M>1 metal filaments; and a step of assembling the N strands by cabling to form the extracted cord.

15. The method according to claim 14, wherein M ranges from 3 to 18.

16. A reinforced product comprising a polymer matrix and at least one multi-strand cord according to claim 1.

17. A tire comprising at least one multi-strand cord according to claim 1.

18. A tire comprising the reinforced product according to claim 16.

* * * * *